US006845530B2

(12) United States Patent
Briere

(10) Patent No.: US 6,845,530 B2
(45) Date of Patent: Jan. 25, 2005

(54) CONVERTIBLE CRIB AND BED ARRANGEMENT

(75) Inventor: Ronald William Briere, Troutman, NC (US)

(73) Assignee: LaJobi Industries, Inc., Cranberry, NJ (US)

( * ) Notice: Subject to any disclaimer, the term of this patent is extended or adjusted under 35 U.S.C. 154(b) by 0 days.

(21) Appl. No.: 10/426,955

(22) Filed: May 1, 2003

(65) Prior Publication Data

US 2004/0216228 A1 Nov. 4, 2004

(51) Int. Cl.[7] ..... A47D 7/01
(52) U.S. Cl. ..... 5/93.2; 5/2.1
(58) Field of Search ..... 5/2.1, 93.2

(56) References Cited

U.S. PATENT DOCUMENTS 4,361,919 A 12/1982 Hull
5,054,138 A 10/1991 Wesley
5,077,846 A * 1/1992 Wheeler et al. ..... 5/93.2
5,148,561 A 9/1992 Tharalson et al.
5,163,190 A * 11/1992 Hwang ..... 5/93.2
5,173,974 A 12/1992 Proano et al.
5,297,305 A * 3/1994 Williams ..... 5/655
5,430,899 A 7/1995 Chisholm
5,715,551 A 2/1998 Proano et al.
5,790,994 A 8/1998 Leonard

* cited by examiner

*Primary Examiner*—Michael Trettel
(74) *Attorney, Agent, or Firm*—Nixon Peabody LLP; Tim L. Brackett, Jr.

(57) ABSTRACT

The present invention provides and article of furniture which is convertible into each a crib, a toddler bed, and an adult bed comprising generally of a rear frame, a left side frame, a right side frame, and a front frame. Each frame includes support portions which extend to a support surface and provide structural support. The support portions between the front framer and the side frame can be in abutment such that a dual-leg support arrangement is achieved. Moreover, the front frame is used for both the crib and adult bed arrangements without the need for additional support components to form toddler bed. Similarly, the side frames are used in both the crib and toddler bed arrangements without the need for additional support components to form the adult bed.

20 Claims, 2 Drawing Sheets

CONVERTIBLE CRIB AND BED ARRANGEMENT

FIELD OF THE INVENTION

The present invention relates to an article of furniture which may be converted into the form of a crib, a youth bed, or an adult bed.

DESCRIPTION OF THE RELATED ART

The primary objective of the present invention is to provide a convertible crib and bed arrangement which may easily be converted from a crib into a toddler's bed and then into a full size bed, thereby obviating the necessity to purchase additional pieces of bed furniture as a child grows older. Specifically, the convertible bed of the present invention precludes the need to replace the crib with a toddler bed and the toddler bed with an adult bed as the child grows.

As infants grow to be toddlers and continue to develop from children into adults, bedding requirements change. Typically, cribs are suitable for infants. More often than not, cribs are provided with a boundary disposed about the entire periphery of the mattress for the purpose of protecting and preventing the infant from rolling off of the mattress onto the floor, thus preventing the infant from injuring himself or herself.

As the infant becomes a toddler, he or she eventually requires substantially more space. Traditionally, the crib is commonly replaced with a suitable youth bed and, more generally, with a bed configured specifically for the needs of a toddler. For example, unlike an infant, a toddler may be able to bed himself or herself, without being totally dependent on the parent or guardian to place himself or herself in the bed. However, although it may be true of toddlers that they can enter and exit the bed without the aid of their parent or guardian, they may still require a security barrier to protect them from rolling off of the edge of the toddler bed while sleeping.

Unfortunately, few toddler bed configurations provide an integrated security barrier feature. As the toddler matures through his or her childhood, there will come a time when he or she will no longer have need for a security barrier.

Finally, the child reaches adulthood and a still greater amount of bedding space is desired. Again, as was the case with the crib, the toddler bed will need to be replaced. The replacement of a bed is usually compounded with the replacement of an entire ensemble including headboard, footboard, and bed rails. This may be a very expensive venture over time.

Thus, a single article of furniture which is configurable to form a crib, a toddler bed, or an adult bed would virtually eliminate a scheduled replacement of furniture and, in effect, eliminate a periodic replacement of entire groups of furniture.

As a result, bed designers have created to convertible articles of furniture which can be configured to form a crib, a toddler bed, or an adult bed by rearranging existing elements and adding required minimal components. For example, U.S. Pat. No. 5,173,974 issued Dec. 29, 1992 and U.S. Pat. No. 5,715,551 issued Feb. 10, 1998 to Proano et al. describes an article of furniture which is convertible to form a crib, a youth bed, or an adult bed. Specifically, both of these references disclose that a crib arrangement is convertible into a youth bed by a procedure which includes the removal of a portion of the front panel of the crib. The youth bed is then converted into an adult bed by, among other things, attaching leg portions to the front panel portion.

Accordingly, one disadvantage of the article of furniture disclosed by Proano et al. is that conversion of the article of furniture from one arrangement into certain different arrangements requires additional structural components, such as the required additional leg portions of the front panel portion, in order to successfully convert the article of furniture from one arrangement into the adult bed. Thus, the necessary use of additional components inconveniences the user of the article of furniture by requiring the user to either store the additional components when the article of furniture is being used in one of the arrangements which does not require those additional components, or to purchase the additional components at an additional expense when the user desires to convert the article of furniture into the adult bed, which requires the use of the additional components.

Therefore, there exists a need for an improved article of furniture which is convertible into a crib, a toddler bed, and an adult bed, without the required addition of structural components, thereby allowing for simple conversion of the article of furniture from one arrangement, such as the toddler bed arrangement, into another arrangement, such as the adult bed arrangement.

SUMMARY OF THE INVENTION

It is, therefore, one object of the present invention to provide an article of furniture which eliminates the need to obtain additional bed furniture as a child grows from infancy to adulthood.

It is another object of the present invention to provide an article of furniture which is easily, simply, and inexpensively convertible into a crib, a toddler bed, and an adult bed.

It is still another object of the present invention to provide an article of furniture which is convertible into a crib, a toddler bed, and an adult bed without the necessary addition of structural components.

It is a further object of the present invention to provide an article of furniture which eliminates the necessary purchasing of additional support components when converting the article of furniture from one arrangement to another.

It is still a further object of the present invention to provide an article of furniture which is convertible into a crib, a toddler bed, and an adult bed and wherein the front frame of the article of furniture provides structural support to the article of furniture when arranged in both the crib and adult bed arrangements.

It is still a further object of the present invention to provide an article of furniture which is convertible into a crib, a toddler bed, and an adult bed and wherein the side frames of the article of furniture provide structural support to the article of furniture when arranged in both the crib and toddler bed arrangements.

It is still a further object of the present invention to provide an article of furniture which is convertible into a crib, a toddler bed, and an adult bed and wherein both the front frame and side frames of the article of furniture provide structural support to the article of furniture is in the crib arrangement.

The above objects and other objects are achieved by providing an article of furniture which can be converted from a crib, a toddler bed, and an adult bed, without the required addition of any structural support components when converting from one arrangement to another.

In particular, an article of furniture is provided which is convertible into each of a crib, a toddler bed, and an adult bed comprising a rear frame, a left side frame including a left front end, wherein the left front end includes a left side support portion, a right side frame including a right front end, wherein the right front end includes a right side support portion, and a front frame including a left front support portion and a right front support portion. The left side support portion, the right side support portion, the left front support portion, and the right front support portion each extends to a support surface and provides structural support for the article of furniture of the present invention. Furthermore, the left side support portion is positioned immediately adjacent to the left front support portion, and the right side support portion is positioned immediately adjacent to the right front support portion, when the article of furniture is converted into the crib.

The above objects, and other objects, are also achieved by providing an article of furniture convertible into each of a crib, a toddler bed, and an adult bed, comprising primarily of a rear frame, a front frame, a right side frame, and a left side frame. The rear frame includes a right rear support portion and a left rear support portion. The front frame includes a right front support portion and a left front support portion. The right front support portion is detachably connected to the right rear support portion of the rear frame via a right adult bed rail, and the left front support portion is detachably connected to the left rear support portion of the rear frame via a left adult bed rail portion. This detachable connection occurs when the article of furniture is converted into the adult bed. The right side frame includes a right rear end, a right front end, and a right side support portion. The right rear end is detachably connected to the right rear support portion when the article of furniture is converted into the crib and the toddler bed. The right side support portion is positioned at the right front end and is detachably connectible to the right front support portion when the article of furniture is converted into the crib. The left side frame includes a left rear end, a left front end, and a left side support portion. The left rear end is detachably connected to the left rear support portion when the article of furniture is converted into the crib and the toddler bed. The left side support portion is positioned at the left front end and is detachably connectible to the left front support portion when the article of furniture is converted into the crib. A toddler bed rail is detachably connectible to the right side support portion and left side support portion when the article of furniture is converted into the crib and the toddler bed. Each support portion extends to a support surface and provides structural support. Moreover, the left side support portion, the right side support portion, the left front support portion, and the right front support portion are leg portions.

Moreover, embodiments includes the following features. Specifically, each of the support portions of the article of furniture can be leg portions. Furthermore, the left side support portion can be in abutment with the left front support portion and the right side support portion can be in abutment the right front support portion. Additionally, the abutment between the left side support portion and said left front support portion, and the abutment between the right side support portion and the right front support portion, can extend from the support surface to the top of each of the right side support portion, the left side support portion, right front support portion, and the left front support portion. Also, the left side support portion can have a flat surface facing the left front support portion and the right side support portion can have a flat surface facing the right front support portion. Similarly, the left front support portion can have a flat surface facing the left side support portion and the right front support portion can have a flat surface facing the right side support portion.

Thus, as described briefly above and in detail below, the present invention provides an article of furniture which is convertible into a crib, a toddler bed, and an adult bed.

DETAILED DESCRIPTION OF THE INVENTION

Figure 1:
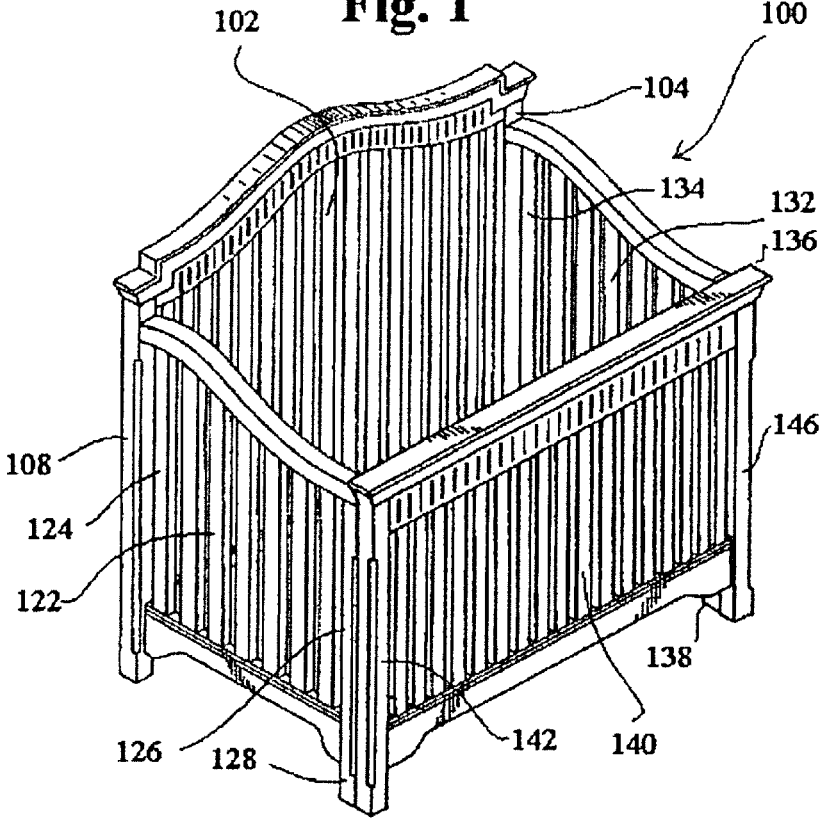
FIG. 1 is an orthogonal view of the crib of the present invention.
Figure 3:
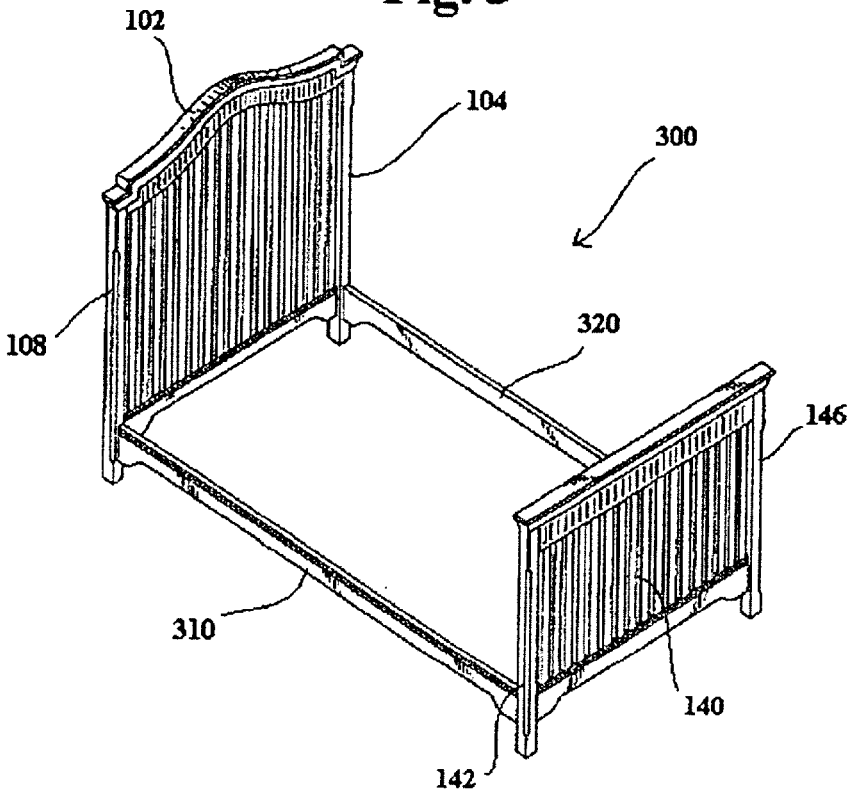
FIG. 3 is an orthogonal view of the adult bed of the present invention.
Figure 2:
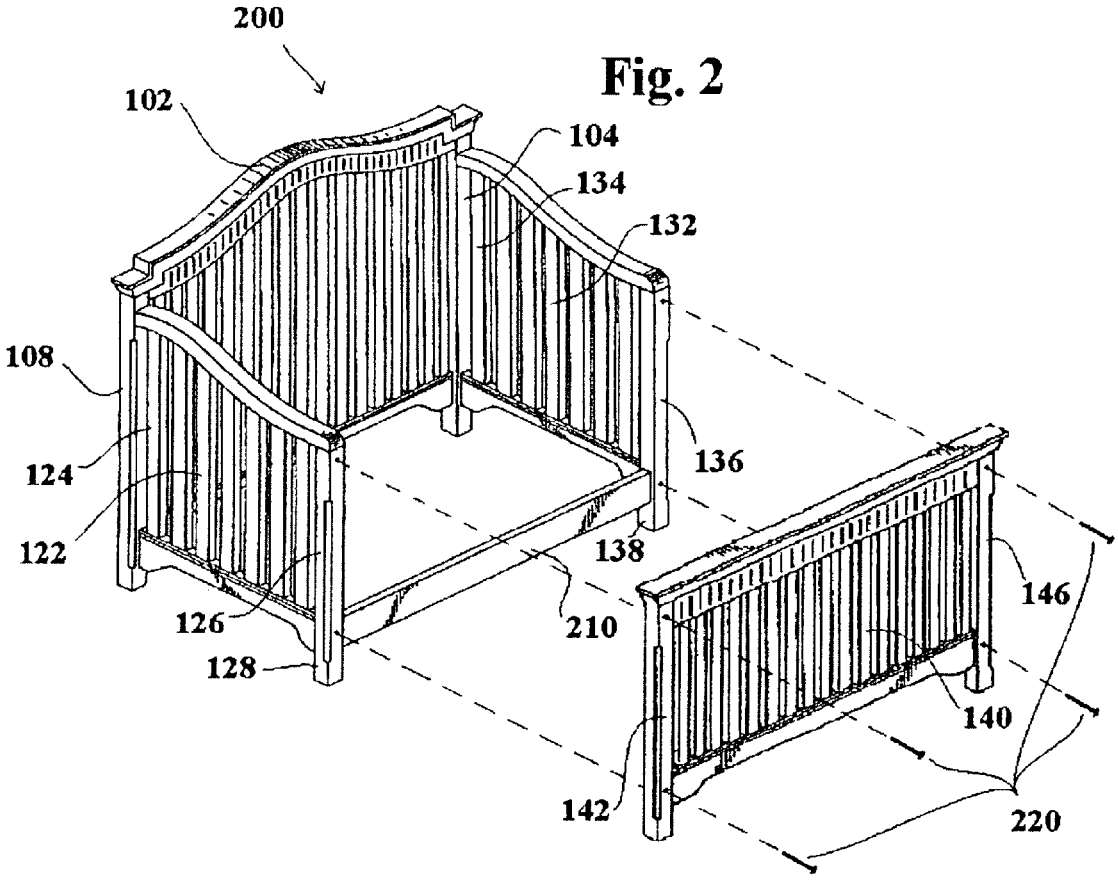
FIG. 2 is an orthogonal view of the toddler bed of the present invention.

The present invention, as shown in FIGS. 1–3, is an article of furniture convertible to form a crib, a toddler bed, and an adult bed. The present invention provides an article of furniture that eliminates the need to purchase or otherwise obtain replacement bed furniture as a child grows from an infant to a toddler to an adult. In particular, when the child is an infant, he sleeps in the crib of the present invention. When the child grows from an infant to a toddler and outgrows the crib, the article of furniture of the present invention is converted from the crib to the toddler bed. Finally, when the child grows from a toddler to a child and then to an adult and outgrows the toddler bed, the article of furniture of the present invention is converted from the toddler bed to the adult bed.

In the present invention, the crib is intended for use with very young children, in particular, infants who are unable to climb in and out of bed on their own. Specifically, the crib is designed to prevent a child from falling out of the crib, thereby possibly injuring himself. The crib also provides the parents or guardians of an infant with the comfort of knowing that their child is safe in the crib and will not fall out and injure himself or herself.

Referring to FIG. 1, crib 100 is generally rectangular in shape with substantially vertical boundaries. However, it should be noted that while the preferred embodiment of the present invention is generally rectangular in shape, the crib of the present invention may be of any shape suitable to comply with the remaining features of the invention. Because of the boundaries, a child can peacefully sleep on the mattress portion without rolling out of crib 100. Additionally, if the child were to awake, the child would be unable to climb over the boundaries and out of the crib and possibly injure himself.

Crib 100 is generally formed by rear frame 102, left side frame 122, right side frame 132, toddler bed rail 210 (See FIG. 2), and front frame 140. Rear frame 102 is substantially vertical and provides structural support along the rear side of crib 100. Rear frame 102 includes support portions, specifically left rear support portion 108 and right rear support portion 104. Moreover, rear frame 102 extends vertically above the mattress portion similar to a common headboard of a traditional bed.

According to the preferred embodiment, each support portion described in the present invention is shown in FIGS. 1–3 to be a leg portion. For example, left rear support portion 108 and right rear support portion 104 are each shown as leg portions. Similarly, each of the support portions of left side frame 122, right side frame 132, and front frame 140 are shown to be leg portions. The leg portions according to the present invention are elongated supports for contacting a support surface, i.e. the floor of the room, and extending upwardly for connection to other portions of article of furniture of the present invention. However, the support portions are not limited to leg portions, and may be in any form sufficient to provide support as described herein.

Left side frame 122 is generally vertical and provides structural support along the left side of crib 100 of the present invention. Left side frame 122 structurally supports the crib by way of left front end 126, with left front end 126 including left side support portion 128. As shown in FIG. 1, left side frame 122 slopes down from the rear frame 102 towards the front frame 140. This feature is included in the preferred embodiment because it improves the appearance of left side frame 122 and right side frame 132 and more clearly defines the distinctions between front frame 140 and rear frame 102. Additionally, the slope of left side frame 122 serves a guide for the placement of crib 100, such as against a wall. It also implies that a child should enter and exit crib 100 over front frame 140.

Additionally, left side frame 122 is detachably connected to rear frame 102. Left rear end 124 is attached to left rear support portion 108 by any known attachment means, such as bolts or screws.

Right side frame 132 is also generally vertical and provides structural support along the right side of crib 100. Right side frame 132 structurally supports crib 100 by way of right front end 136, with right front end 136 including right side support portion 138. As shown in FIG. 1, left side frame 132 slopes down from rear frame 102 towards front frame 140. This feature is included in the preferred embodiment because it improves the appearance of left side frame 122 and right side frame 132 and more clearly defines the distinctions between front frame 140 and rear frame 102. Additionally, the slope of right side frame 132 serves a guide for the placement of crib 100, such as against a wall. It also implies that a child should enter and exit crib 100 over front frame 140.

Right side frame 132 is detachably connected to rear frame 102. Right rear end 134 is attached to right rear support portion 104 by any known attachment means, such as bolts or screws.

Toddler bed rail 210 (see FIG. 2) provides structural support along the front of crib 100 by connecting left front support portion 128 and right front support portion 138. According to the preferred embodiment, toddler bed rail 210 is attached to left front support portion 128 and right front support portion 138 by any known attachment means, such as bolts or screws. Additionally, the ends of toddler bed rail 210 abut the inner sides of left front support portion 128 and right front leg portion 138.

Front frame 140 is substantially vertical and provides structural support along the front side of the crib. According to the preferred embodiment, front frame 140 includes support portions, specifically left front support portion 142 and right front support portion 146. Moreover, front frame 140 extends vertically above the mattress portion similar to a common footboard of a traditional bed.

Front frame 140 is detachably connected to the front side of crib 100. Specifically, left front support portion 142 is attached to left side support portion 128 by any known attachment means, such as bolts or screws, such that left front support portion 142 is adjacent to left side support portion 128. Therefore, both structurally support crib 100. Similarly, right front support portion 146 is attached to right side support portion 138 by any known attachment means, such as bolts or screws, such that right front support portion 146 is adjacent to right side support portion 138 and both structurally support crib 100.

Crib 100 is thus supported by left rear support portion 108, right rear support portion 104, left front support portion 142, right front support portion 146, left side support portion 128, and right side support portion 138. Horizontal support for crib 100 is provided by rear frame 102, left side frame 122, right side frame 132, toddler bed rail 210, and front frame 140.

When in the crib arrangement, an infant may sleep in the crib while the boundaries provided by rear frame 102, front frame 140, left side frame 122, and right side frame 132 will prevent the child from rolling or climbing out of the crib.

Moreover, when the crib is assembled, left front support portion 142 is immediately adjacent to left side support portion 128, and right front support portion 146 is immediately adjacent to right side support portion 138. Preferably, these adjacent support portions are in a side-by-side relationship in abutment with one another to form a more robust combined support that is capable of being simply and easily separated to permit effective conversion from the crib to the toddler bed or adult bed. This unique dual-leg arrangement provides improved structural support for the crib and is key to each of the arrangements of the present invention.

A mattress portion may then be positioned inside crib 100 to provide cushioning for the infant.

As the child grows older, the infant becomes a toddler and achieves the ability to bed himself. When it becomes possible for the child to enter and exit the bed safely on his own, the crib of the present invention may be converted into the toddler bed. This conversion enables a toddler to have access to the bed because the toddler bed has boundaries on only three sides. Access to the front of the toddler bed is not prevented by the front frame as in the crib.

The conversion from the crib to the toddler bed is very simple can consists primarily of only one action. As shown in FIG. 2, toddler bed 200 is formed by removing front frame 140 from the crib of the present invention by removing attachment means 220 from front frame 140 and then removing front frame 140 from left side frame 122 and right side frame 132. After front frame 140 is removed from left side frame 122 and right side frame 132, toddler bed 200 is formed. Toddler bed 200 thus consists of rear frame 102, left side frame 122, right side frame 132, and toddler bed rail 210. Since each of these components has been described in detail above, a detailed description will not be repeated here.

In the preferred embodiment, both left side frame 122 and right side frame 132 slope down from rear frame 102 towards the front side of toddler bed 200. This sloping is a design feature which improves the appearance of toddler bed 200.

Toddler bed 200 will be structurally supported by left rear support portion 108, right rear support portion 104, left side support portion 128, and right side support portion 138. Horizontal stability is provided by rear frame 102, left side frame 122, right side frame 132, and toddler bed rail 210.

In some cases, a toddler who can enter and exit toddler bed 200 on his own may still need a barrier to prevent him from rolling out of toddler bed 200 when sleeping. Therefore, an optional security barrier (not shown) may be connected to toddler bed rail 210, left side support portion 128, and right side support portion 138 in the toddler bed of the present invention. The optional security barrier may include a section through which the toddler may enter and exit the bed, with the remainder of the optional security barrier being a boundary portion to prevent a sleeping child from rolling out of toddler bed 200 and injuring himself or herself. As the toddler grows and the need for protection for falling our of bed decreases, the security barrier may be removed.

It is a key feature of the present invention that although front frame 140 is removed, toddler bed 200 remains structurally supported. If left side frame 122 and right side frame 132 did not include structural supports, such as left side support portion 128 and right side support portion 138, the conversion from crib 100 to toddler bed 200 by removal of front frame 140 would have left the front side of toddler bed 200 totally unsupported, and thus, ineffective. Thus, left side frame 122 and right side frame 132 are used in both crib 100 and toddler bed 200 without the need for additional support components to form adult bed 300.

Eventually, as the toddler grows into adulthood, the toddler bed may not be sufficient to bed the child. At this point, the child will no longer need the protection or security provided by the boundaries utilized in the crib and toddler bed. The child is ready for an adult bed which does not include those boundaries. Thus, the present invention also provides an adult bed using the primary structural components of the crib and toddler bed described above.

Referring to FIG. 3, adult bed 300 is formed by a conversion of toddler bed 200. In general, the adult bed is formed by first removing the side frames of the toddler bed from the rear frame, and then connecting the rear frame to the front frame with adult bed rails. Specifically, to convert from toddler bed 200 to adult bed 300, left side frame 122 and right side frame 132 are removed from rear frame 102. Left rear end 124 is removed from left rear support portion 108, and right rear end 134 is removed from right rear support portion 104. Left side frame 122 and right side frame 132 are not used in adult bed 300 as shown in the preferred embodiment.

Adult bed 300 is thus formed of rear frame 102, front frame 140, left adult bed rail 310, and right adult bed rail 320. Left adult bed rail 310 provides structural support along the left side of adult bed 300 by connecting left rear support portion 108 to left front support portion 142. Specifically, left adult bed rail 310 is first connected to left rear support portion 108 by any known attachment means. Left adult bed rail 310 is then connected to left front support portion 142 by any known attachment means. Similarly, right adult bed rail 320 provides structural support along the right side of adult bed 300 by connecting right rear support portion 104 and right front support portion 146. Specifically, right adult bed rail 320 is first connected to right rear support portion 104 by any known attachment means. Right adult bed rail 320 is then connected to right front support portion 146 by any known attachment means. The known attachment means of the above-described connections may be any detachable connective devices such as bolts, screws, or a clip and groove connection.

Thus, adult bed 300 is structurally supported by rear frame 102, front frame 140, left adult bed rail 310 and right adult bed rail 320. A mattress portion of appropriate size may then be positioned on the adult bed to provide cushioning.

Is this manner, a generally rectangular adult bed is formed. Adult bed 300 is structurally supported by left rear support portion 108, right rear support portion 104, left front support portion 142, and right front support portion 146. Adult bed 300 is horizontally supported by rear frame 102, front frame 140, left adult bed rail 310, and right adult bed rail 320.

It is a key feature of the present invention that although left side frame 122 and right side frame 132 were removed, adult bed 300 remains structurally supported using only rear frame 102 and front frame 140. If front frame 140 did not include structural supports, such as left front support portion 142 and right front support portion 146, the conversion from toddler bed 200 to adult bed 300 by removal of left side frame 122 and right side frame 132 would have left the front side of adult bed 300 totally unsupported, and thus, ineffective. Thus, front frame 140 is used for both crib 100 and adult bed 300 without the need for additional support components to form toddler bed 200.

Finally, each of the frames and bed rails of the present invention, including rear frame 102, front frame 140, left side frame 122, right side frame 132, toddler bed rail 210, left adult bed rail 310, and right adult bed rail 320, can be constructed of any type of material that is suitable for furniture construction, including, but not limited to wood, metal, plastic, and composite materials.

Furthermore, while the preferred embodiment shows the frames and bed rails in a style which includes spaced vertical bars, each of the frames and bed rails can be of any style, including, but not limited to a solid one-piece frame, an open frame design with vertical or horizontal bar portions, or any other frame design.

Additionally, the frames can be of any height relative to the mattress portion sufficient to prevent an infant from rolling or climbing out of the crib.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

We claim:

1. An article of furniture convertible into each of a crib, a toddler bed, and an adult bed, said article of furniture comprising:

a rear frame;

a left side frame including a left front end, wherein said left front end includes a left side support portion;

a right side frame including a right front end, wherein said right front end includes a right side support portion; and a front frame including a left front support portion and a right front support portion;

wherein said left side support portion, said right side support portion, said left front support portion, and said right front support portion each extend to a support surface and provide structural support for the article of furniture; and wherein said left side support portion is positioned immediately adjacent to said left front support portion, and said right side support portion is positioned immediately adjacent to said right front support portion, when the article of furniture is converted into the crib.

2. The article of furniture of claim 1, wherein said left side support portion is a leg portion.

3. The article of furniture of claim 1, wherein said right side support portion is a leg portion.

4. The article of furniture of claim 1, wherein said left front support portion is a leg portion.

5. The article of furniture of claim 1, wherein said right front support portion is a leg portion.

6. The article of furniture of claim 1, wherein said left side support portion is in abutment with said left front support portion.

7. The article of furniture of claim 1, wherein said right side support portion is in abutment said right front support portion.

8. The article of furniture of claim 1, wherein said left side support portion is in abutment with said left front support portion and said right side support portion is in abutment said right front support portion.

9. The article of furniture of claim 8, wherein the abutment between said left side support portion and said left front support portion extends from the support surface to the top of said left side support portion and said left front support portion.

10. The article of furniture of claim 8, wherein the abutment between said right side support portion and said right front support portion extends from the support surface to the top of said right side support portion and said right front support portion.

11. The article of furniture of claim 1, wherein said left side support portion has a flat surface facing said left front support portion and said right side support portion has a flat surface facing said right front support portion.

12. The article of furniture of claim 1, wherein said left front support portion has a flat surface facing said left side support portion and said right front support portion has a flat surface facing said right side support portion.

13. An article of furniture convertible into each of a crib, a toddler bed, and an adult bed, said article of furniture comprising:

a) a rear frame including a right rear support portion and a left rear support portion;

b) a front frame connectible to said rear frame, said front frame including a right front support portion and a left front support portion, wherein said right front support portion is detachably connected to said right rear support portion via a right adult bed rail, and said left front support portion is detachably connected to said left rear support portion via a left adult bed rail portion, when said article of furniture is converted into said adult bed;

c) a right side frame including a right rear end detachably connected to said right rear support portion when said article of furniture is converted into said crib and said toddler bed, a right front end, and a right side support portion positioned at said right front end for detachable connection to said right front support portion when said article of furniture is converted into said crib;

d) a left side frame including a left rear end detachably connected to said left rear support portion when said article of furniture is converted into said crib and said toddler bed, a left front end, and a left side support portion positioned at said left front end for detachable connection to said left front support portion when said article of furniture is converted into said crib; and e) a toddler bed rail detachably connectible to said right side support portion and left side support portion when said article of furniture is converted into said crib and said toddler bed;

wherein each said support portion extends to a support surface and provides structural support.

14. The article of furniture of claim 13, wherein said left side support portion, said right side support portion, said left front support portion, and said right front support portion are leg portions.

15. The article of furniture of claim 13, wherein said left side support portion is in abutment with said left front support portion.

16. The article of furniture of claim 13, wherein said right side support portion is in abutment said right front support portion.

17. The article of furniture of claim 13, wherein said left side support portion is in abutment with said left front support portion and said right side support portion is in abutment said right front support portion.

18. The article of claim 17, wherein the abutment between said left side support portion and left front support portion extends from the support surface to the top of said left side support portion and said left front support portion.

19. The article of claim 17, wherein the abutment between said right side support portion and right front support portion extends from the support surface to the top of said right side support portion and said right front support portion.

20. The article of claim 13, wherein said left side support portion has a flat surface facing and left front support portion, said right side support portion has a flat surface facing said right support portion, said left front support portion has a flat surface facing said left side support portion and said right front support portion has a flat surface facing said right side support portion.

* * * * *